US005894821A

United States Patent [19]

Chatelain

[11] Patent Number: 5,894,821

[45] Date of Patent: Apr. 20, 1999

[54] AIR VALVE SYSTEM COMBINED WITH A DISTRIBUTION CHAMBER

[76] Inventor: Michel Chatelain, 10 rue du Ramponnet, F-74740 Annecy le Vieux, France

[21] Appl. No.: 08/737,632

[22] PCT Filed: May 17, 1995

[86] PCT No.: PCT/FR95/00639

§ 371 Date: Nov. 18, 1996

§ 102(e) Date: Nov. 18, 1996

[87] PCT Pub. No.: WO95/31634

PCT Pub. Date: Nov. 23, 1995

[30] Foreign Application Priority Data

May 18, 1994 [FR] France ..... 94 06045

[51] Int. Cl.[6] ..... F02B 75/02

[52] U.S. Cl. ..... 123/65 V; 123/65 P; 123/74 AC

[58] Field of Search ..... 123/65 V, 65 VC, 123/65 P, 74 R, 74 AC

[56] References Cited

U.S. PATENT DOCUMENTS

| | | | |
|---|---|---|---|
| 1,407,585 | 2/1922 | Setz | 123/65 V |
| 1,407,586 | 2/1922 | Setz | 123/65 V |
| 1,899,217 | 2/1933 | Taylor et al. | 123/65 P |
| 1,972,589 | 9/1934 | Henter | 123/65 VC |
| 1,992,328 | 2/1935 | Schaer | 123/65 V |
| 2,206,332 | 7/1940 | Radelet et al. | 123/65 V |
| 2,620,125 | 12/1952 | Kilchenmann | 123/65 V |
| 2,704,056 | 3/1955 | Petersen | 123/65 V |
| 5,158,046 | 10/1992 | Rucker | 123/65 R |

FOREIGN PATENT DOCUMENTS

| | | |
|---|---|---|
| 590192 | 6/1925 | France . |
| 222761 | 2/1909 | Germany . |
| 386966 | 12/1923 | Germany . |
| 3838684 | 4/1990 | Germany . |
| 286629 | 2/1953 | Switzerland . |

*Primary Examiner*—David A. Okonsky
*Attorney, Agent, or Firm*—William A. Drucker

[57] ABSTRACT

According to the invention, the valve comprises a cylindrical body (21) in a housing (21), for receiving one end of a return spring while the end is in contact with the case. The valve also includes two ribs (22, 23) for connection to a sealing plate (25) contacting the inner surface of an annular chamber (27) above an opening (26) thereof. The annular chamber is arranged to shorten the distance between the valve and the corresponding transfer port. The air valve of the invention is for spark ignition engines, in particular two-stroke engines.

16 Claims, 3 Drawing Sheets

AIR VALVE SYSTEM COMBINED WITH A DISTRIBUTION CHAMBER

FIELD OF THE INVENTION

The present invention concerns an air valve system combined with a distribution chamber used as a seat for the valves. It concerns also a chamber able to be in the housing or the cylinder or between the two. It finally concerns an internal combustion engine, specifically of the "two-stroke" type, equipped with an entrance port device controlled by a new valve system.

BACKGROUND OF THE INVENTION

The invention can be used for internal combustion engines and specifically "two-stroke" engines.

SUMMARY OF THE INVENTION

The object of the invention is to improve the filling of cylinders. It also seeks to provide filling of greater than 1 by means of a double suction during each cycle.

So as to achieve this aim, according to one characteristic of the invention, the valves are placed very close to ports (or openings).

In the prior art, modern "two-stroke" engines are equipped with a valve chamber mounted in the engine crankcase or housing.

These valves are reed type valves. They are secured to a housing so as to facilitate machining of the seats, imperviousness and mounting. Only one side of their opening is limited by a stop plate.

This disposition of the valves in the housing results in said valves means that they are located some distance away from the transfer ports and open into a large volume which forms a buffer and eliminates the sensitivity of the valves. This renders it difficult for the gases to enter the valve chamber.

The invention seeks to overcome these drawbacks of the prior art. In fact, it concerns a valve system for an internal combustion engine entrance device. The invention is specifically characterized in that each valve comprises a housing to receive the end of a return spring, said housing being placed on the rear face of a closing plate, said plate being shaped and disposed so as to produce the largest possible entrance surface and in that the valve is mounted on a cylindrical surface common to the valves of the valves system which is used as a seat for said valves, and in that the top of the housing 3 is used as a opening stop for the valve.

The invention also concerns an internal combustion engine chamber disposed in the crankcase, in the cylinder, or between these two elements, and which receives a valve system disposed on the orifices.

Finally, the invention concerns an internal combustion engine, specifically of the "two-stroke" ignition type. The invention is characterized in that the engine comprises a valve system disposed on a distribution chamber, said valves being placed as described previously, entrance ports and transfer ports opening into the same chamber.

BRIEF DESCRIPTION OF THE DRAWINGS

Other advantages and characteristics of the invention shall be more readily understood from a reading of the description and drawings represented as follows.

DETAILED DESCRIPTION OF THE PREFERRED EMBODIMENTS

Figure 4:
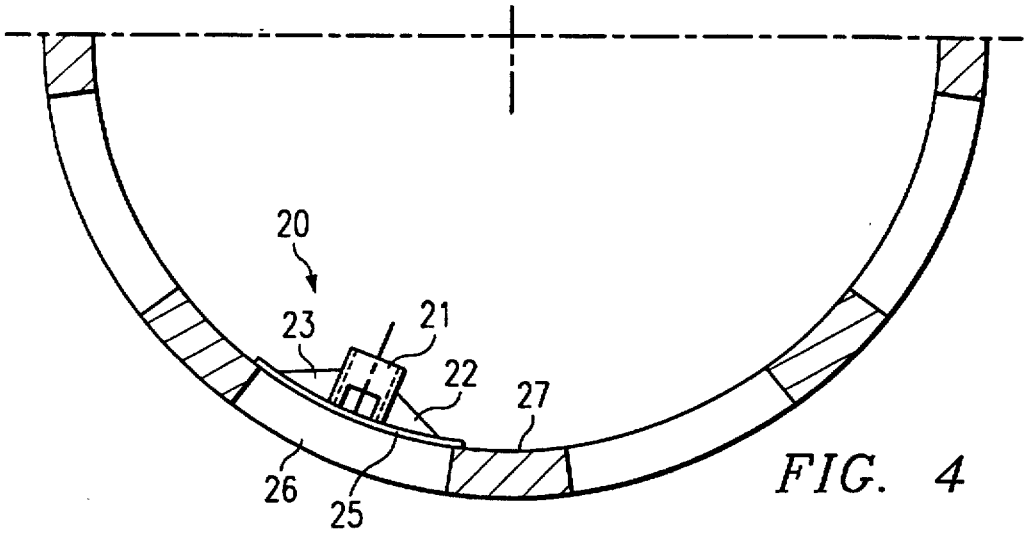
FIG. 4: a partial view of an annular chamber used as a seat for the valve system of the invention.

According to one characteristic of the invention, the valves are disposed on a circumference. FIG. 4 shows only one valve with its housing 21 for receiving the extremity of the return spring (not shown), two ribs 22 and 23 fastened to a closing plate 25 in the orifice 26 of the internal circumference 27 pierced on cylindrical plate common to the valves of the valve system and in this instance formed by the annular distribution chamber shown as a half-size view. A total number of eight valves have been provided (including one valve and four orifices shown on FIG. 4). The top portion of the housing 21 is used as an opening stop for the valve. The valves are positioned and guided by:

firstly, the spring used as a link between its two opposing housings: the housing of the valve spring and the positioning housing 13 (see FIG. 5), and secondly by one of the longitudinal faces of the valve which slides via the resilience of the spring on one face of the support of the housing 13.

This preferred disposition makes it possible to have the largest possible entrance surface in correspondence with the pressure stages on the course of the cycle.

In addition, it makes it possible to reduce the height of the valves, which results in more space being obtained, the spatial requirement being reduced and obtaining a reduction of weight.

According to another characteristic of the invention, the housing of the valves (FIG. 4) is situated in a small volume annular chamber (FIG. 5), the transfer ports (7, FIG. 5) forming part of this chamber. This preferred disposition enables the valves to react at the slightest partial vacuum in a minimum period of time. The closing plate covers the seat at the right of the opening of the chamber over a predetermined distance ensuring the imperviousness of the valve.

According to a third characteristic of the invention, the shape of the valves is partially cylindrical at the level of the closing plate 25 (FIG. 4) of the orifice of the annular chamber. This shape renders the valves highly rigid which enables them to be manufactured with a technical plastic. Because of this, the weight of the valve is extremely light (0.5 to 1 grams). This light weight makes it more mobile as it can beat over 100 times per second.

According to a fourth characteristic of the invention, the valve guiding system comprises a support face and the positioning by the housings of the single return spring 10 (FIG. 5) renders mounting easier and reduces prices and noise. The spring is firstly mounted on the valve and then the valve slides together with its spring on its seat. The spring slackens in the housing 13 when it arrives opposite the latter.

Figure 1:
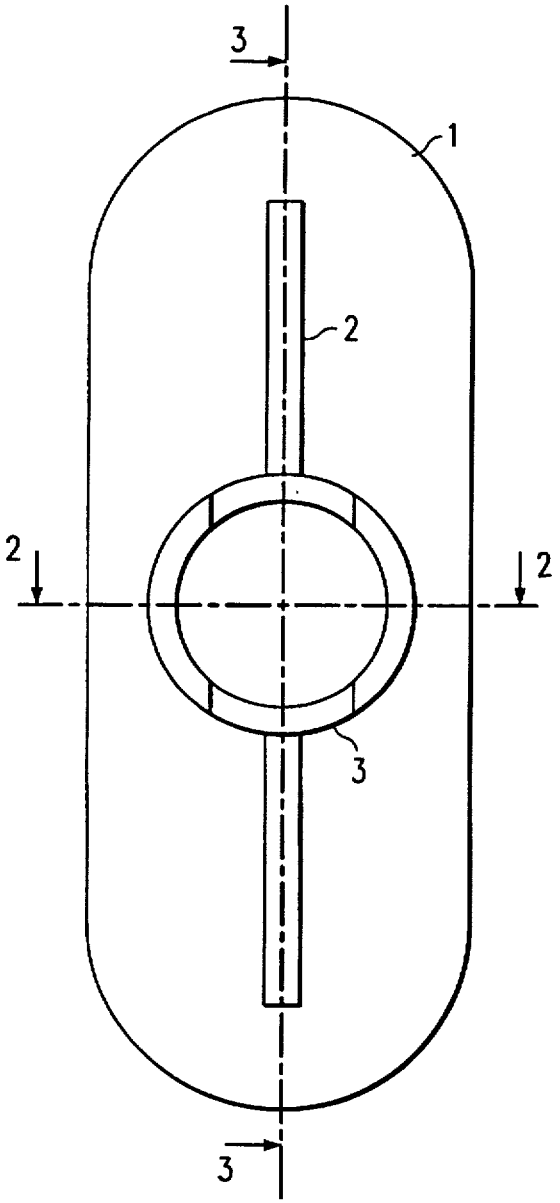
FIGS. 1 to 3: three views of a valve of a system of the invention.

FIG. 1 shows a rear view of the valve before being mounted on the annular chamber.

It comprises a housing inserted into a cylindrical portion 3 and two ribs like the rib 2 linking the outer wall of the cylindrical housing 3 to the rear face of the closing plate 1 of the orifice 26 (shown on FIG. 4).

Figure 2:
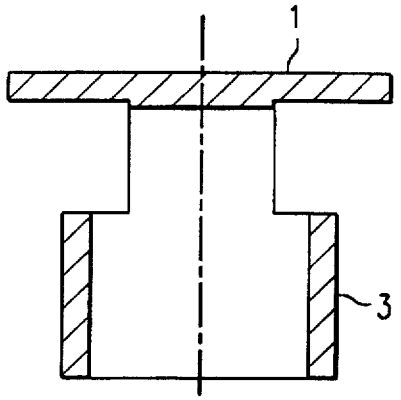
Figure 5:
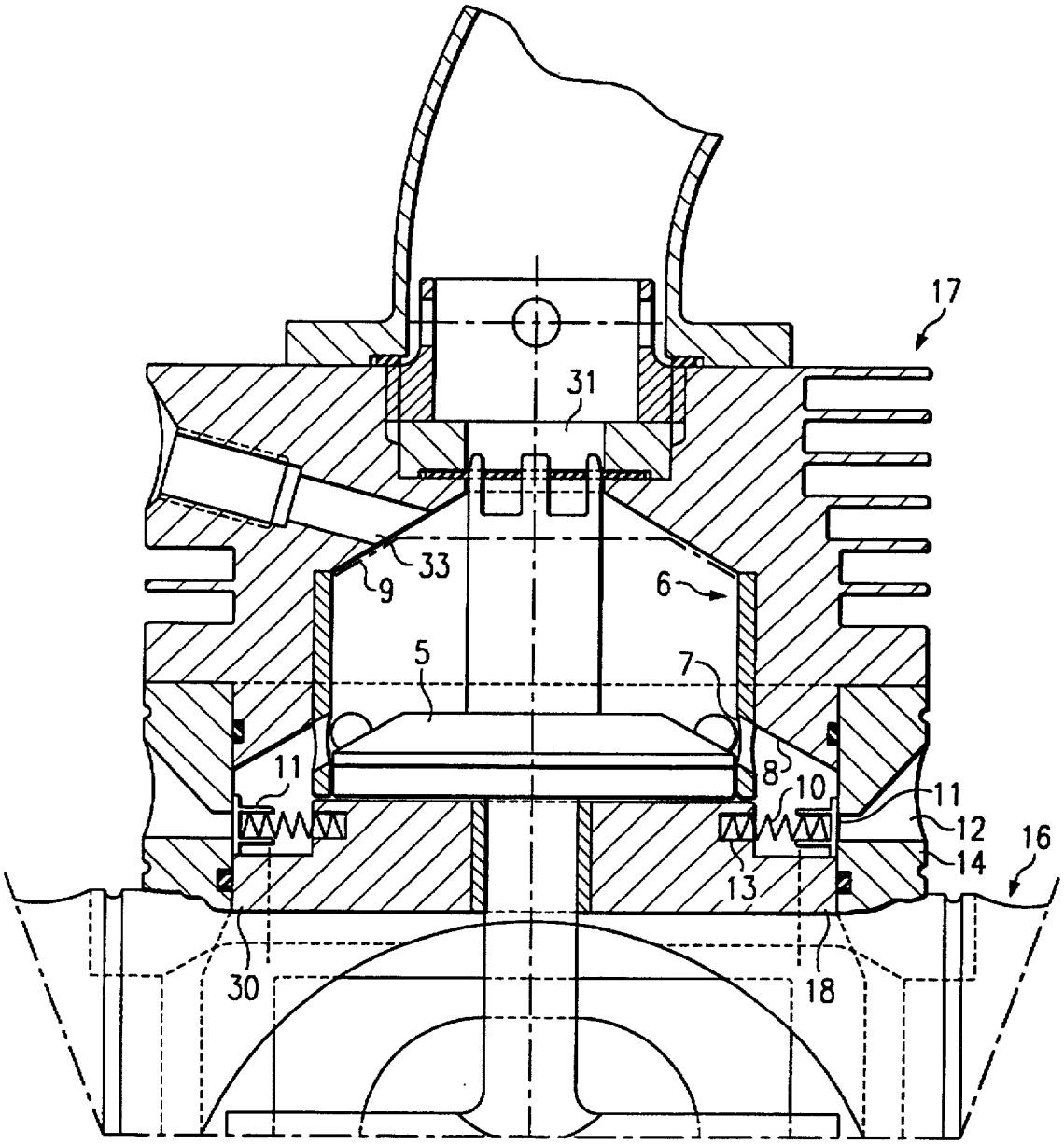
FIG. 5: a partial sectional view of a "two-stroke" ignition engine of the invention.

FIG. 2 shows a front sectional view along the line 2—2 of the valve of FIG. 1, the closing plate 1 of the section showing of the orifice of the annular chamber (not show) and the housing of the cylindrical body 3 which receives the return spring 10 on the FIG. 5.

Figure 3:
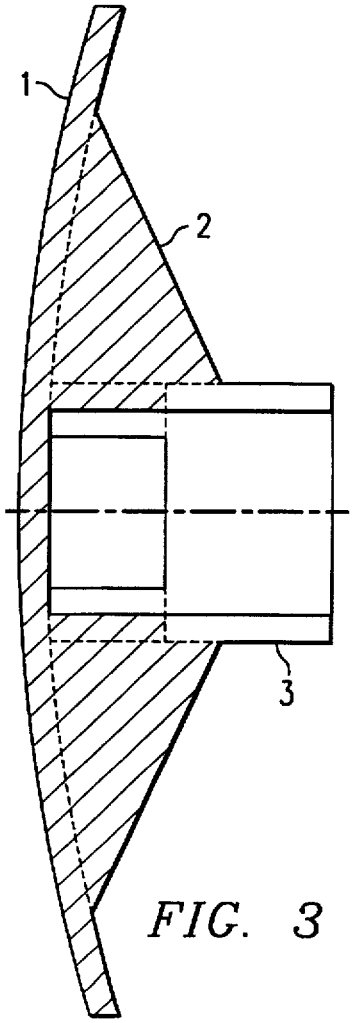

FIG. 3 shows a sectional view along the line 3—3 of the valve of the FIG. 1 clearly showing the cylinder portion shape of the closing plate 1. The radius of the cylinder portion is equal to the internal radius R of the internal circumference of the annular on the orifice of which the valve rests under the action of its return spring (10 of FIG. 5).

In this way, owing to either the excess pressure or partial vacuum existing inside the cylinder during a working cycle of the piston (5 on FIG. 5), the closing plate makes it possible to properly shut the orifice of the chamber by marrying the inner surface of the distribution chamber. The top of the housing 3 of the spring 10 is used as an opening stop. The shape of the chamber of the internal combustion engine of the invention is approximately annular whose height to relatively slight with respect to its radius R. This radius is also the radius of the valve closing plate. The annular chamber comprises on its outer diameter entrance gates and transfer gates on its inner diameter.

FIG. 5 represents a partial cutaway view of a "two-stroke" type ignition engine composed of a unit including:

- a housing 16 on which the rest of the engine is mounted and containing a system for transforming the alternative movement into a rotary movement, like the connecting rod system;
- at least one cylinder 6 mounted on the top of the housing above a suitable opening of the latter and fitted with small fins 17 on at least one face outside the engine so as to cool it and which delimits the stroke chamber of the piston, the outflow being removed via a pipe shown unmarked on FIG. 5;
- a guided piston 5 which slides in the cylinder;
- a bearing 30 for guiding the rod to the piston, and
- a valve system like the valve 11. The piston 5 is at the bottom dead center. The transfer gates 7 are shown in the open position.

In this position, the valves can open twice in the same cycle.

According to the invention, the valves system (10, 11, 13; FIG. 5) is combined with a stepped distribution system adjusted by a two-stage piston (5, FIG. 5).

This disposition means that there are outflow gates on the circumference of the second stage of the piston and at the same height. Similarly, there are transfer gates 7 (FIG. 5) on the first stage and on the entire circumference of the annular chamber 8. These outflow and transfer gates open simultaneously or with a slight shift at the bottom dead center. Behind these transfer gates is an annular chamber 8 and opposite it the valves 11 seen as a section on FIG. 5. This annular chamber and the valve bearings are located in the housing 18 and more particularly in the cylindrical portion of the housing used to support and center the cylinders. This disposition is advantageous as the route the air has to pass through from the air filter to the transfer gates 7 is reduced to a minimum. In one embodiment example, this path is only about 15 mm. This distance reduction procures extremely high sensitivity on the valves which may react to the slightest partial vacuum.

In one embodiment, the valves have a bearing with the shape of a cylinder portion. They are placed in a housing between the cylinder and the bearing 30 of the rigid coupling which closes and isolates this portion of the housing from the rest representing the limit oiled portion of the housing.

In the embodiments of the prior art, the valves are located in the oiled portion of the housing.

For all these reasons and according to this disposition, the precompression volume is small and situated around the transfer gates. The outflow gates 31 can be adjusted so as to dose before the transfer gates 7. In this case, when the outflow gates 31 close, the gases arriving at high speed in the cylinder are compressed at the bottom of the cylinder, thus creating a partial vacuum behind them.

The outflow gates 31 are cut in the second stage of the piston 5 and at the extremity of the latter. Imperviousness is affected on the piston with the inside of a particular static segment.

As these transfer gates 7 are still open, the partial vacuum provokes the opening of the valves 11 a second time in the same cycle and an additional filling of the cylinders.

When the transfer gates 7 are closed by the piston 5, the pressure in the cylinder is greater than the atmospheric pressure before the compression phase starts.

This disposition is notable because the opening of the outflow and entrance gates 31 occurs simultaneously or with a slight shift with the smaller height gates and at the bottom dead center. This is the time when the linear speed of the piston is the slowest. This leaves the gas time to pass, and with gates on all the circumferences, the product of the surface of the gates by the number of degrees during which they remain open represents an extremely large opening. This authorizes an extremely small engine travel for a maximum working travel.

The annular valve system is combined with a stepped distribution system obtained by a two-stage piston 5. The outflow gates 31 are disposed on the second stage of the piston and at the same height. The transfer gates are disposed on the casing of the first stage and at the same height.

The opening of the outflow and transfer gates is effected simultaneously or with a slight shift. When closing of the outflow gates is affected before closing the transfer gates 7, the gases are compressed in the cylinder and bring about a partial vacuum in the entrance chamber which provokes the opening of the valves as twice within the same cycle. Prior to compression, a pressure exceeding the atmospheric pressure is obtained.

When the piston 5 rises inside the cylinder 6, it creates a partial vacuum between the bearing of the rigid coupling and the bottom of the piston.

This volume is connected to the valves by the transfer gates 7 which communicate with the annular chamber 8 were the valves are located.

Under the effect of the partial vacuum, the valves open and allow an air volume sucked up from the entrance gates 12 to pass, this volume corresponding to the partial vacuum volume generated by the movement of the piston up to the top dead center 9 (shown by the dot-and-dash line).

When the piston 5 goes down, the partial vacuum ceases and the valves close and the precompression phase begins. The sucked up volume of air is compressed under the piston 5 and in the annular chamber 8 until the piston 5 opens the transfer 7 and outflow 31 gates situated on the other stage of the piston.

The compressed air volume in the annular chamber then moves into the ignition chamber and the cycle continues.

It is possible to embody the present invention in other ways by making use of the information contained in the present application and are all within the scope of the accompanying claims.

Figure 6:
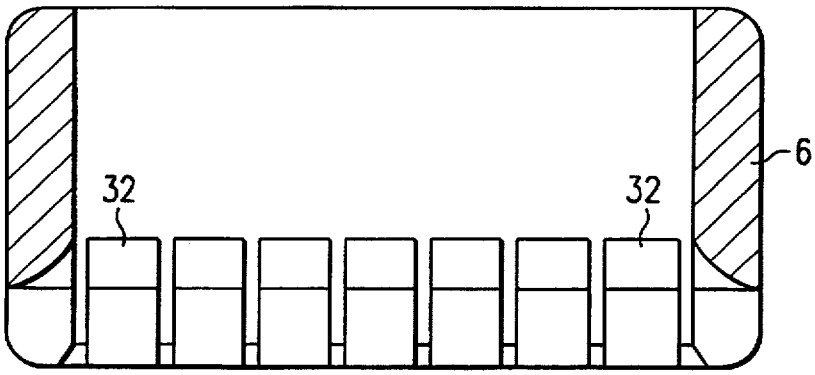
FIG. 6 is a vertical sectional view of a variant of the cylinder of the engine of FIG. 5.
Figure 7:
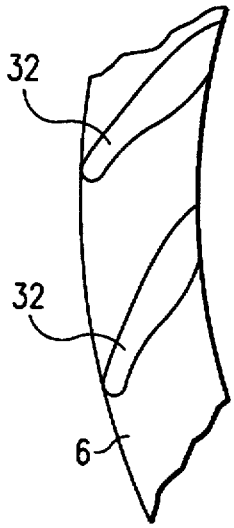
FIG. 7 is an end partial view of the vanes fitted in the wall of the cylinder of FIG. 6.

FIGS. 6 and 7 show a variant of the cylinder 6 of the engine whose lower portion has been machined so as to comprise on its periphery notches 32 collectively determining the spaces corresponding to the transfer gates. The columns of these notches (see FIG. 7) are profiled into the shape of vanes with a double angulation so as to orientate the fresh gases rotating around the shaft of the piston. At the end of compression, for a diesel engine, one or several injectors 33 orientated in the same direction as the rotation of the gases inject fuel along a direction which facilitates the best possible homogeneous mixture with the fresh air.

What is claimed is:

1. A valve system for an internal combustion engine, which comprises a cylindrical surface of which a circumference bears a plurality of parts, and a plurality of valves mounted on said circumference to close sail ports, each one of said valves comprising a closing plate of a partly cylindrical shape seating by a front face on said cylindrical surface to close a said port, and a housing placed on a rear face of said closing plate, said housing receiving one and of a return spring and having a top portion which acts as a stop for a valve opening movement.

2. The valve system according to claim 1, wherein said housing consists of a cylindrical body joined to the rear face of the closing plate by means of at least one rib.

3. The valve system according to claim 1, wherein said valves are made of a plastic.

4. A valve chamber far an internal combustion engine of the type comprising a housing on which at least one cylinder is mounted, wherein said valve chamber is placed in said housing and wherein said valve chamber receives a valve system, said valve system comprising a cylindrical surface of which a circumference bears a plurality of ports, and a plurality of valves mounted on said circumference to close said ports, each one of said valves comprising a closing plate of a partly cylindrical shape seating by a front face on said cylindrical surface to close a said port, and a housing placed an a rear face of said closing plate, said rear housing receiving one end of a return spring and having a top portion which acts as a stop for a valve opening movement.

5. A valve chamber for an internal combustion engine of the type comprising a housing on which at least one cylinder is mounted, wherein said valve chamber is placed in the cylinder and wherein said valve chamber receives a valve system, said valve system comprising a cylindrical surface of which a circumference bears a plurality of ports, and a plurality of valves mounted on said circumference to close said ports, each one of said valves comprising a closing plate of a partly cylindrical shape seating by a front face on said cylindrical surface to close a said port, and a housing placed on a rear face of said closing plate, said rear housing receiving one end of a return spring and having a top portion which acts as a stop for a valve opening movement.

6. A valve chamber for an internal combustion engine of the type comprising a housing on which at least one cylinder is mounted, wherein said valve chamber is placed between said housing and said cylinder and wherein said valve chamber receives a valve system, said valve system comprising a cylindrical surface of which a circumference bears a plurality of ports, and a plurality of valves mounted on said circumference to close said ports, each one of said valves comprising a closing plate of a partly cylindrical shape seating by a front face on said cylindrical surface to close a said port, and a housing placed on a rear face of said closing plate, said rear housing receiving one end of a return spring and having a top portion which acts as a stop for a valve opening movement.

7. The valve chamber as claimed in any one of claims 4 to 6, wherein the valve chamber is annular and has a height relatively short with respect to its radius (R) so as to present a small volume, and said valve chamber comprises entrance ports on its internal diameter and transfer ports on its internal diameter.

8. The valve chamber as claimed in any one of claims 4 to 6, wherein a positioning and a guiding of each one of said valves are obtained:

by said return spring acting as a link between the valve housing, and by one of two longitudinal faces of the valve sliding with the resilience of the return spring on one face of a support of the positioning rear housing.

9. An internal combustion engine comprising at least one cylinder within which a piston moves, housing containing a movement transformation device connected to said piston, and a valve chamber placed in said housing, wherein said valve chamber receives a valve system said valve system comprising a cylindrical surface of which a circumference bears a plurality of transfer ports, said transfer ports connecting the valve chamber to an inside part of the cylinder, and a plurality of valves mounted on said circumference to close said transfer ports, each one of said valves comprising a closing plate of a partly cylindrical shape seating by a front face on said cylindrical surface to close a said transfer ports, and a housing placed on a rear face of said closing plate, said rear housing receiving one and of a return spring and having a top portion which acts as a stop for a valve opening movement.

10. An internal combustion engine comprising at least one cylinder within which a piston moves, a housing containing a movement transformation device connected to said piston, and a valve chamber placed in said cylinder, wherein said valve chamber receives a valve system, said valve system comprising a cylindrical surface of which a circumference bears a plurality of transfer ports, said transfer parts connecting the valve chamber to an inside part of the cylinders, and a plurality of valves mounted on said circumference to close said transfer ports, each one of said valves comprising a closing plate of a partly cylindrical shape seating by a front face on said cylindrical surface to close a said transfer port, and a housing places an a rear face of said closing plate, said rear housing receiving one and of a return spring and having a top portion which acts as a stop for a valve opening movement.

11. An internal combustion engine comprising at least one cylinder within which a piston moves, a housing containing a movement transformation device connected to said piston, and a valve chamber placed between said housing and said cylinder, wherein said valve chamber receives a valve system, said valve system comprising a cylindrical surface of which a circumference bears a plurality of transfer ports, said transfer ports connecting the valve chamber to an inside part of the cylinder, and a plurality of valves mounted on said circumference to close said transfer ports, each one of said valves comprising a closing plate of a partly cylindrical shape seating by a front face on said cylindrical surface to close a said transfer port, and a housing placed on a rear face of said closing plate, said rear housing receiving one and of a return spring and having a top portion which acts as a stop for a valve opening movement.

12. The internal combustion engine of any one of claims 9 to 11, wherein the cylinder comprises at an upper portion an outflow closed off by said piston and at a lower portion transfer ports closed off by said piston, and opposite said transfer ports entrance ports closed off by partial vacuum opening valves.

13. The internal combustion engine according to claim 12 wherein, when said piston is in a low position within said cylinder, the transfer ports and outflow open substantially simultaneously, permitting an outflow of burnt gases and a transfer of precompressed gases contained in the valve chamber.

14. The internal combustion engine according to claim 13, wherein during mounting of said piston within said cylinder, said outflow closes before said transfer ports, thus provoking compression of gases in said cylinder at the level of said outflow and a depression at the level of said transfer ports and of the valve chamber which makes the valves open a second time within a same motor cycle.

15. The internal combustion engine according to any one of claims 9 to 11, wherein said transfer ports consist of notches fitted at an and of said cylinders, and wherein columns of said notches are profiled in a shape of vanes with a double angulation so as to rapidly rotate precompressed gas around a shaft of said piston.

16. The internal combustion engine according to claim 15, wherein it comprises at the upper portion of the cylinder at least one injector oriented in a same direction as the direction of rotation of fresh gases around the shalt of the piston.

* * * * *